United States Patent [19]

Maier

[11] 4,016,924

[45] Apr. 12, 1977

[54] METHOD OF CONTINUOUS CASTING WITH WEIGHTED FLOAT-DISTRIBUTOR

[75] Inventor: Ralph D. Maier, Monroeville, Pa.

[73] Assignee: Aluminum Company of America, Pittsburgh, Pa.

[22] Filed: Sept. 17, 1975

[21] Appl. No.: 614,090

[52] U.S. Cl. ..... 164/82; 137/426; 164/281 R

[51] Int. Cl.[2] ..... B22D 11/10

[58] Field of Search ..... 164/82, 274, 281; 137/410, 426, 432

[56] References Cited

UNITED STATES PATENTS

| | | | |
|---|---|---|---|
| 2,243,425 | 5/1941 | Junghans | 164/281 X |
| 2,876,509 | 3/1959 | Gardner | 164/281 |
| 3,425,482 | 2/1969 | Capaul | 164/281 X |
| 3,467,135 | 9/1969 | Muskalla | 137/410 |
| 3,672,431 | 6/1972 | Bryson | 164/82 |
| 3,752,217 | 8/1973 | Sevier | 164/281 |

*Primary Examiner*—Robert D. Baldwin
*Attorney, Agent, or Firm*—Patrick J. Viccaro; Carl R. Lippert

[57] ABSTRACT

A weighted float-distributor is provided for distributing molten metal and controlling the level of molten metal in a direct chill continuous casting mold. The float-distributor has a float portion supporting a distributor portion for distributing molten metal from a feed spout to the periphery of the mold. A variable weight portion of the float-distributor facilitates varying the molten metal elevation in the mold by varying the weight of the float-distributor without the need for repositioning either the feed spout or the casting mold.

12 Claims, 5 Drawing Figures

METHOD OF CONTINUOUS CASTING WITH WEIGHTED FLOAT-DISTRIBUTOR

BACKGROUND OF THE INVENTION

This invention relates to an improved method and system for the vertical continuous, or seim-continuous, casting of molten metal to provide solidified ingot thereof.

More particularly, the invention relates to a method and system for distributing molten metal in a vertical open ended mold of the type often designated a direct-chill mold and including a molten metal distributor arrangement which floats in the molten metal within the mold and includes a variable weighted system which facilitates control of the molten metal level or head in the casting mold.

The improvement is particularly suited to the direct-chill casting of light metals, specifically aluminum, magnesium, and their alloys.

In general, a process of direct chill continuous casting of metals includes feeding a molten metal into a vertical open-ended mold and continuously withdrawing a solid casting from the lower end of the mold. At the initiation of the casting operation when molten metal is fed into the mold, the lower end is closed by a downward movable bottom die. A supply of cooling fluid is continuously applied to the mold and also to the solid ingot surface as the ingot emerges from the lower end of the mold as the movable bottom die moves downwardly. It is desirable in the process to distribute the molten metal to provide a homogeneous solid casting having a relatively smooth surface free from thermal cracks, cold shuts and other defects. Such defects can introduce problems in later fabricating operations such as rolling and can add to the costs of fabrication by necessitating a machining operation to remove a surface portion of the casting having the defects. It is therefore desirable to reduce or eliminate any defects from the outer surface of a continuous cast ingot.

It is known in the art to provide a distributor, generally disposed beneath a feed spout, for laterally spreading molten metal flowing from a spout to uniformly distribute the molten metal and its heat content to the sides of the mold. A distributor may have a float portion which allows the float-distributor to float in the molten metal and rise and fall within the mold as the level of molten metal changes in the mold. In such manner, the float-distributor operates as a valve to control metal flow rate through the spout by engaging against the lower end of the feed spout when the molten metal flow rate is too great, and the molten metal head (i.e. height of molten metal in the mold) is too high. Similarly, when the molten metal level is too low in the mold, the float-distributor is lowered away from the lower end of the spout to permit more molten metal to enter the mold. Thus, the float-distributor acts as a leveling control to maintain a constant molten metal head throughout the casting operation. U.S. Pat. No. 2,876,509 granted Mar. 10, 1959, U.S. Pat. No. 3,672,431 granted June 27, 1972, and U.S. Pat. No. 3,752,217 granted Aug. 14, 1973, illustrate various configurations of the prior art to distribute molten metal and to maintain a constant level of molten metal in the mold.

It is further known in the art that a lower head of molten metal in the mold improves the surface characteristics of the ingot produced. One reason for such an improved surface is that there is less contact between the solidifying molten metal and the mold before it emerges from the lower end of the mold. At the initiation of the continuous casting operation, however, if the distance between the float-distributor and the movable bottom die of the mold is too small, the float-distributor tends to freeze in the solidifying metal. That problem can be solved by providing a higher head of molten metal at initiation of the casting operation, and changing to a lower head after casting is begun. U.S. Pat. No. 3,425,482 granted Feb. 4, 1969, discloses raising the mold or lowering the tundish or feed spout into the mold to lower the head of molten metal in the mold ater the casting operation is initiated. Such an arrangement can add to the complexity of the continuous casting operation and can be costly to install and operate. Furthermore, operating a substantial number of molds, typically 6 to over 20, at the same time as is commercial practice further increases the costs and complexity of operation. Therefore, it is desirable to provide an uncomplicated and inexpensive system that can be readily incorporated into existing direct chill continuous casting arrangements to lower the molten metal head in the mold during casting to improve the surface quality of a continuous cast ingot.

SUMMARY OF THE INVENTION

In accordance with the present invention, the level of molten metal in a direct-chill continuous cast mold is lowered after the initiation of casting by an uncomplicated arrangement which obviates any need to move either the tundish or spout supplying the molten metal or the mold. Generally stated, the invention contemplates weighting or downwardly urging or decreasing the buoyancy of the floating distributor assembly at the initiation of casting. The downwardly urged floating distributor requires a molten metal level to support it which is higher than required without the downward urging effect thus achieving a higher molten metal level for the initiation of casting. After the casting is initiated downward urging of the floating distrubtor is decreased (or its buoyancy increased) thereby allowing a lower level of molten aluminum to maintain the distributor at a given elevation. This extremely uncomplicated arrangement facilitates the transition from the higher position to the lower position of molten metal in the casting mold without the need for any intricate or cumbersome system to alter the elevation of either the mold or the molten metal supply system or both. This is particularly important in multiple mold casting systems where raising or lowering a plurality of molds, for instance 6 to 20 or more molds, or repositioning the respective molten metal supply nozzles associated therewith obviously introduces complications.

DETAILED DESCRIPTION OF THE PREFERRED EMBODIMENTS OF THE INVENTION

Figure 1:
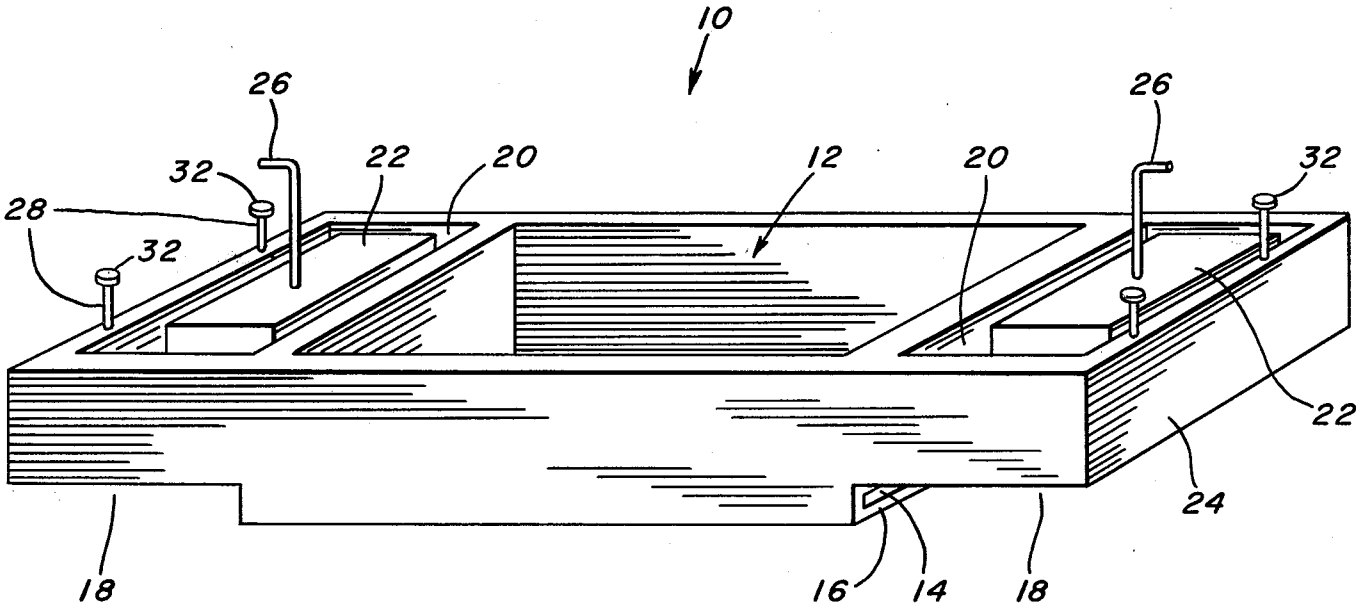
FIG. 1 is a perspective view of an embodiment of a float-distributor of the present invention.

FIG. 1 illustrates a perspective view of a preferred embodiment of the weighted float-distributor 10 of the present invention. The float-distributor 10 includes a distributor portion 12 having elongated opening 14 adjacent a distributor pan 16 at the bottom of the distributor portion 12, and float portion arms or extensions 18 having recesses 20 for receiving weights 22.

Distributor portion 12 is configured like a receptacle having an opening at the top thereof for receiving molten metal from a feed spout. Two float portions 18 extend from opposite sides of distributor 12 to aid in providing flotation in the molten metal during the casting operation. Distributor 12 includes a distributor pan 16 for spreading molten metal laterally. The pan 16 can be viewed as closing the distributor portion 12 except for elongate opening 14 positioned at the lateral extremities of distributor pan 16 at the bottom of distributor portion 12 and below float portions 18. Preferably, a similar opening is on opposite walls of distributor 12, with both openings 14 permitting molten metal to flow therethrough to the outer portions of the mold opening.

While the entire float-distributor 10 can be made of a material that porivdes both flotation and can withstand the high temperatures of molten metal, it is within the scope of this invention, however, that distributor 12 and float portions 18 can be made of different materials. One suitable material in which to provide the entire float-distributor is a commercial asbestos-silica product sold under the trade name "Marinite".

In accordance with the preferred embodiment as illustrated in FIG. 1, each float portion 18 has a recess 20 for receiving a weight 22. Recess 20 is of sufficient depth to contain weight 22 and provide a sufficiently low center of gravity to assure a stable float characteristic and to restrict movement of the weight 22 that may result during the casting operation. The float portions 18 are provided with sidewalls 24 that are of sufficient height to maintain the float-distributor 10 afloat in molten metal whether or not float-distributor 10 is weighted with weights 22 in recesses 20. This is better illustrated in FIGS. 2–4, discussed hereinbelow, which show the level of molten metal at various heights on the sidewall of float portions 18 corresponding to diffferent points in the operation in accordance with the invention. Weight 22 may be provided with a stem 26 or other suitable means to facilitate removal of weight 22 from recess 20 of the float-distributor 10. Arrangement of float-distributor 10 in a continuous casting mold can include a mechanism such as a pulley or camshaft connected to weights 22 to facilitate their removal. Vertical guide pins 28 having stop heads 32 thereon can be provided to maintain a float-distributor in vertical axial alignment with a feed spout as the height of the level of molten metal in a casting mold changes. Pins 28 extend vertically upward from float-distributor 10 to register with holes in a guide bar (not shown) positioned across the top of a continuous casting mold. Stop heads 32 are secured to the upper ends of pins 28 above the guide bars to support the float-distributor 10 prior to casting.

Figure 3:
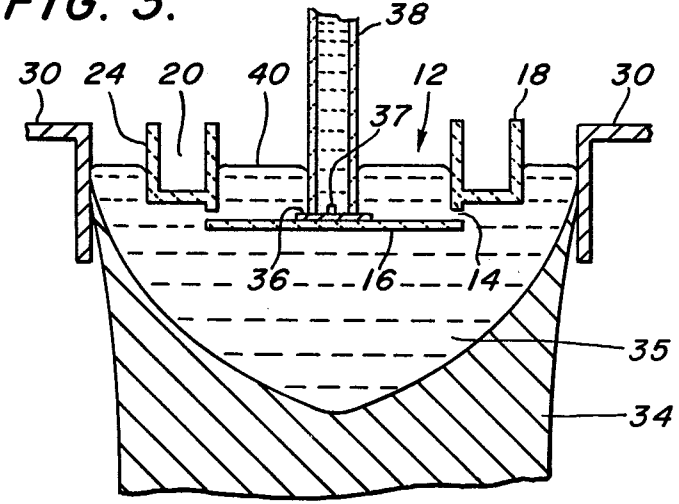
FIGS. 2, 3 and 4 are elevation views in cross-section illustrating the invention at different stages of operation.
Figure 2:
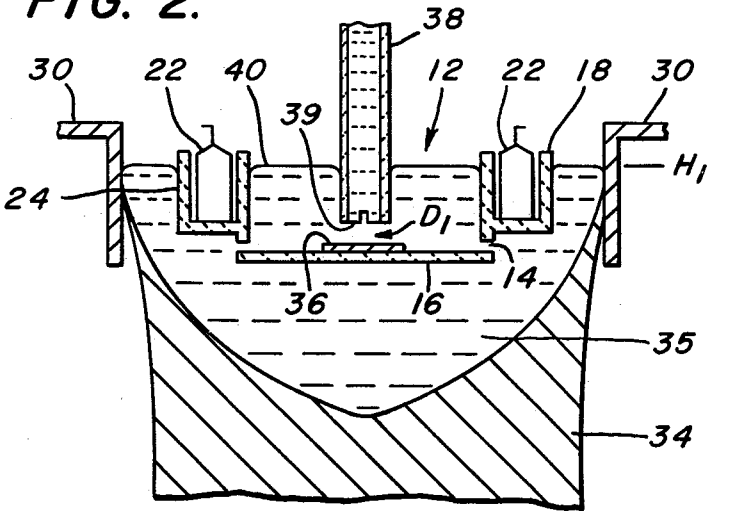
Figure 4:
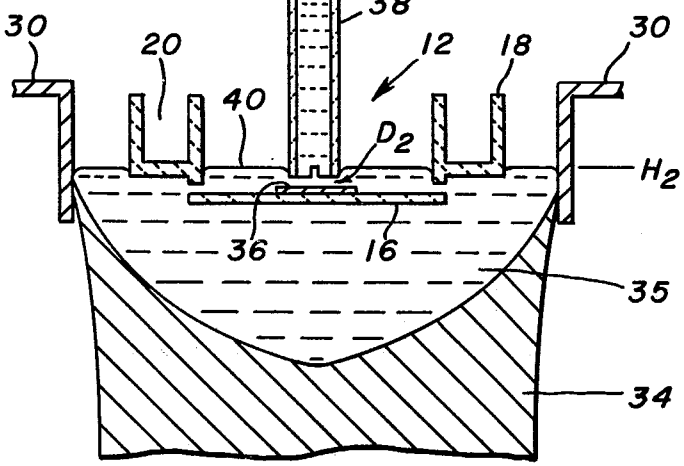

FIGS. 2, 3 and 4 respectively illustrate three progressive stages or modes in a continuous casting operation utilizing the improved practices of the present invention.

FIG. 2 illustrates a cross-section of the weighted float-distributor 10 in place in a continuous casting mold 30 having a high head of molten metal, shortly after the beginning of the casting operation. A bottom die (not shown) of the casting mold has lowered out of the mold 30, and a continuous casting metal ingot having a solid portion 34 and a molten liquid portion 35 is shown emerging from the lower end of mold 30. Weights 22 are located in recesses 20 of float portions 18 of the float-distributor 10. Feed spout 38 is located in distributor 12 between float portions 18 to deliver molten metal into the opening of mold 30. Molten metal flowing into the distributor moves across distributor pan 16 and flows out openings 14 to the periphery of mold 30. A raised boss 36 is provided on pan 16 to protect the pan 16 from the errosive action of the molten metal and to facilitate closing the spout when the float-distributor 10 is raised sufficiently. The boss is typically provided in cast iron. The distance between the lower end of spout 38 and raised boss 36 is indicated by the letter $D_1$. The surface 40 of molten metal 35 provides a high head of molten 35 in mold 30 as indicated by $H_1$, the height of the surface 40 from the lower end of mold 30. As illustrated, the height of surface 40 on sidewall 24 of float ears 18 is also high, i.e. the float-distributor with weights 22 floats lower in the molten metal 35.

FIG. 3 illustrates the condition just after the weights 22, shown in FIG. 2, are removed. The float-distributor 10 is shown to have buoyed upward in the molten metal pool 35 until raised boss 36 on distributor pan 16 contacts the lower end 39 of spout 38 restricting the molten metal flow from spout 38. Preferably, spout 38 has notches or slots 37 at its lower portion to permit some flow of molten metal and its heat content into the molten pool 35 so as to prevent freezing in the peripheral surface portions of the molten metal pool which could cause a cold shut to form. Molten pool surface 40 is still momentarily high in mold 30, that is, it is still at or near the $H_1$ position, but will fall as a result of the restricted metal flow through spout 38 and the continuing withdrawal of ingot 34 from the mold. The height of molten metal surface 40 on the sidewall 24 of float portions 18 is lower than that shown in FIG. 2 since the float-distributor 10 buoyed upward upon removal of weights 22.

FIG. 4 illustrates the condition after the float-distributor 10 has stabilized, some time subsequent to the condition of FIG. 3. The surface 40 of molten metal pool 35 is now positioned lower in mold 30 as indicated by $H_2$. Float-distributor 10 is floating higher in the molten metal 35. The height of surface 40 is, therefore, lower on the sidewall 24 of float portion 18. The lower end or mouth 39 of spout 38 and raised boss 36 of distributor pan 16 are spaced a distance $D_2$ which can be equal to or vary from $D_1$ in FIG. 2 but not by very much as it regulates the molten metal flow through spout 38 with a rate commensurate with that of ingot 20 emerging from mold 30.

The $H_1$ position in FIg. 2 might be as much as 6 inches or more above the mold outlet although, in casting aluminum a height of 3 or 4 inches is typical with $H_1$ levels as low as 1 ½ or 2 inches being useful but sometimes on a less preferred basis. The $H_2$ position in FIG. 2 is typically around 1 inch or a little less, for instance one half or three four inch, extremely low levels obviously introducing a risk of molten metal spillage. The $H_2$ position can be greater than 1 inch, for instance 1 1/4 inch, or even up to 1 ½ inch or 2 inches. The difference between the $H_1$ and $H_2$ heights can be as little as about one half inch although for many aluminum alloys a differential of 1 or 1 ½ to 2 or 3 inches is useful.

Figure 5:
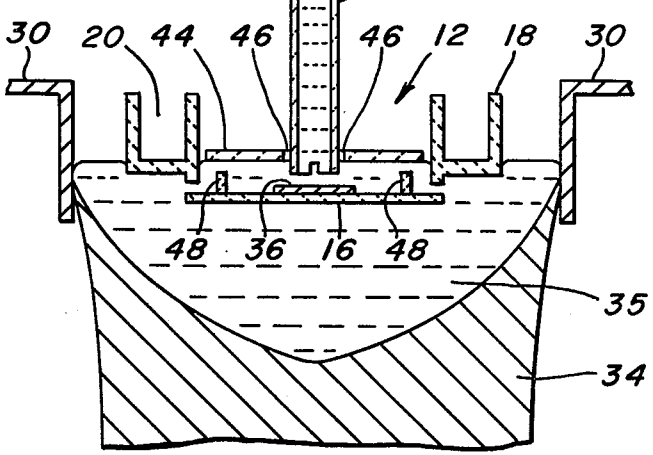
FIG. 5 is an elevation cross-section of a preferred embodiment of the invention.

A preferred embodiment of the invention is shown in FIG. 5. The reduced depth of molten metal above distributor pan 16 as shown in FIG. 4 can result in some turbulence in the molten metal moving across the distributor pan 16 particularly near the mouth or exit of spout 38. Where the molten metal is oxidizable, such as is the case with molten aluminum, this turbulence can result in oxides forming in te molten metal. This turbulence is not as severe in the high head $H_1$ position, mode of operation shown in FIG. 2, but can be present in the low head $H_2$ position, mode shown in FIG. 4. In accordance with the present invention, it is preferred to provide plate 44 floating on the surface of the molten metal above distributor pan 16. The floating plate 44 has a hole 46 through which spout 38 passes. Plate 44 is configured to fit within distributor 12 so as to float freely on surface 40 of molten metal 35. Plate 44 reduces some turbulence at the surface 40 of the molten metal 35 and, further, reduces contact of molten metal 35 with the air above surface 40 in distributor 12. Stop pegs 48 extend upwardly from the pan 16 to separate plate 44 and distributor pan 16 to prevent freezing of plate 44 to the distributor pan 16 at the beginning or end of a casting operation. Also, it is preferred that the mouth of spout 38 extend below the plate 44 prior to casting when plate 44 is resting on stop pegs 48.

In accordance with the present invention, feed spout 38 and mold 30 can remain stationary in a continuous casting operation while the weighted float-distributor 10 distributes molten metal, controls the level of molten metal, and adjusts the head of molten metal to case ingots having a desired smooth surface quality.

Prior to beginning the continuous casting process using the weighted float-distributor 10 of the present invention, the float-distributor 10 is placed in position in mold 30 and supported by guide pins 28 and stop heads 32. Feed spout 38 is positioned through hole 46 in plate 44 which is resting on support pegs 48 in distributor 12. Float-distributor 10 is positioned with distributor pan 16 a distance above the movable bottom die of mold 30 to prevent freezing of distributor pan 16 in the solidifying metal upon beginning the casting operation. Weights 22 are located in recesses 20 of float-distributor 10. Molten metal is delivered by feed spout 38 and is spread laterally by distributor pan 16 beneath plate 44. Float-distributor 10 begins to float in the molten metal 35 and plate 44 floats on the molten metal surface 40 within the confines of distributor 12. The bottom die of mold 30 is moved downwardly to commence the casting operation. After a sufficient amount of molten metal is delivered, a stable condition of metal flow commensurate with ingot withdrawal is established in distributor 12 and mold 30 and the condition as to operation is as depicted in FIG. 2. Weights 22 are removed from recesses 20 of float-distributor 10 and the float-distributor 10 will rise to float higher in molten metal 35 as generally depicted in FIG. 3. This closes, or considerably reduces, the distance $D_1$ between the lower end 39 of spout 38 and raised boss 36 on distributor pan 16, thus curtailing or reducing metal flow out of the spout 38. It is preferable to remove weights 22 slowly and simultaneously to allow float-distributor 10 to buoy upward evenly without splashing molten metal, and to prevent raised boss 36 from forcefully striking the outlet 39 of spout 38 and possibly damaging the spout or float-distributor. Since ingot withdrawal continues, the reduced molten metal flow produces a temporary instability as to molten metal feed and ingot withdrawal thus causing the molten metal level to fall. After the molten metal level has dropped a appreciable distance, float-distributor 10 begins to drop from spout 38 thus providing for more molten metal flow until the molten metal flow into the mold corresponds with the rate of ingot withdrawal from the lower end of mold 30 and stability is re-established, but at the reduced $H_2$ molten metal level in the mold. From that point, float-distributor 10 operates in the more or less normal fashion to control the level of molten metal in the mold but at low head casting conditions to produce ingot of improved surface.

Because of the fact that in the low head mode of operation the ingot is more quickly exposed to the effects of the direct cooling applied to the ingot surface, there is increasing possibility of metal freezing up into the portions at the surface 40 of the molten pool. Hence, it can be desirable to either retard the rate of heat extraction at the ingot surface as it exits the mold or, sometimes more preferably, to accelerate the rate of ingot withdrawal. For instance, under normal casting conditions a given alloy at a given ingot size might be cast at a withdrawal rate of say 2 inches per minute. When casting under low head ($H_2$) conditions, that same ingot might be withdrawn at a rate of 3 inches or 4 inches per minute in order to avoid freezing back to the surface 40 of the pool 35. Thus the invention contemplates gradually increasing the casting rate concurrently with removal of the weights and proceeding with casting at the reduced $H_2$ molten metal height but at an ingot withdrawal rate greater than that for the $H_1$ casting condition. The greater withdrawal rate for the $H_2$ mode can be from around 25% greater up to around 5 or 6 times the withdrawal rate for the $H_1$ condition, although for casting aluminum increased withdrawal rate typically can range from around 1 ½ to 2 ½ or 3 times the initial rate.

As the casting proceeds towards the termination of the casting run, it is not necessary to reposition the weights 22 and retard the casting rate to the conventional or $H_1$ condition. That is, just before the end of casting, conditions need not be caused to revert back to the $H_1$ or FIG. 2 scheme of operation. This facilitates continuous casting of metal ingot at optimum conditions of improved surface quality, i.e. at $H_2$ condition, until the end of casting without the need to revert to the less desirable $H_1$ condition and its resulting poorer surface qualities.

There is one condition however in which the weights can be repositioned to advantage and this can occur in healing a longitudinal surface crack which can develop on the ingot surface as it forms in the mold. When the crack is observed, the weights are repositioned which causes a rapid rise in the molten metal level to the $H_1$ position. It is believed that this condition can cause the crack to heal and when the ingot exiting the mold shows that the crack is in fact healed the weights 22 can be removed and casting at the $H_2$ position resumed.

In order to more completely understand the invention, the following illustrative example is presented.

EXAMPLE

In continuously casting ingots of aluminum alloy 3005, containing nominally 1.2% Mn and 0.4% Mg, balance essentially aluminum, the ingots having a substantially rectangular cross section of, for example, 16 inches by 40 inches, the $H_1$ level, referring to FIG. 2, above the mold bottom might typically be around 3 ½ inches and the casting rate might be around 2 inches per minute. The surface of such an ingot would typically be characterized by cyclic liquation defects. Such ingot, prior to rolling, is typically scalped to remove about one four inch from each rolling surface, i.e. the 40 inch wide surfaces.

The same ingot is cast in accordance with the invention wherein the improved distributor float system initially includes weights which are positioned on the float portions, each weight weighing about 5 pounds. Casting is initiated according to the FIG. 2 mode of operation, the mold initially being closed by a dummy block or die. Casting proceeds at a rate of 2 inches per minute and after about 4 inches of ingot are produced the weights are removed. This causes the condition illustrated in FIG. 3 to occur wherein the distributor assembly 10 rises to substantially close the spout 38 except for more or less minor amounts of molten metal passing through slots 37. Substantially simultaneously with the removal of the weights the rate of ingot withdrawal is increased gradually to about 3 or 4 inches per minute. During the stage of gradual withdrawal rate increase the molten metal level drops relatively rapidly to the $H_2$ position and the mode of operation changes to that depicted in FIG. 4. During this mode a constant ingot withdrawal rate of 3 or 4 inches prevails and the ingot surface exhibits a marked improvement in that it is substantially free from the cyclic liquation defects such that it can be rolled with substantially no metal removed by scalping. In fact, ingots have been cast and rolled with no surface metal removal whatsoever and rolling has proceeded without incident of the type normally associated with surface defects.

While the invention is described with particular reference to aluminum and its alloys it is believed suited to use with other metals, particularly non-ferrous metals and especially to light metals meaning aluminum or magnesium or their alloys.

Although a preferred embodiment and alternative embodiments have been illustrated and described, it will be apparent to those skilled in the art that many changes can be made therein without departing from the scope of the invention.

What is claimed is:

1. In a method of continuously casting ingot wherein molten metal is continuously supplied to the entrance of an open-ended substantially vertical mold and an ingot is withdrawn from the mold exit, and wherein heat is extracted from said ingot by direct chill application, and wherein the supply of molten metal to the mold is controlled at a rate substantially commensurate with that of ingot withdrawal by cooperation between a molten metal supply nozzle and a float-distributor means responsive to molten metal level within the mold, said float-distributor being maintained afloat in the surface portions of the molten metal, the improvement comprising the steps of:

a. downwardly urging said float-distributor means to cause said float-distributor means to float lower in the molten metal, thereby causing a relatively high molten metal level within the mold; and b. thereafter decreasing the downward urging of the said float-distributor means to cause said float-distributor means to float higher in the molten metal thereby to cause a reduced height of molten metal within the mold, said decreasing of the downward urging of said float-distributor means causes a reduction in the rate of molten metal introduction into the mold to establish a instability condition with respect to molten metal feed and ingot withdrawal rate after which said float-distributor means settles downwardly as a result of decreasing molten metal level in said mold during said instability condition, stability between molten metal feed and ingot withdrawal rates being re-established at said reduced molten metal height, and continuing the casting operation while substantially maintaining said reduced height of molten metal in said mold.

2. In a method of continuously casting ingot wherein molten metal is continuously supplied to the entrance of an open-ended substantially vertical mold and an ingot is withdrawn from the mold exit, and wherein heat is extracted from said ingot by direct chill application, and wherein the supply of molten metal to the mold is controlled at a rate substantially commensurate with that of ingot withdrawal by cooperation between a molten metal supply nozzle and a float-distributor means responsive to molten metal level within the mold, said float-distributor being maintained afloat in the surface portions of the molten metal, the improvement comprising the steps of:

a. initially closing the exit of said mold by a temporary closure;

b. commencing the casting operation by withdrawing the temporary closure and the solidified ingot attached thereto at a determined ingot withdrawal rate;

c. downwardly urging said float-distributor means to cause said float-distributor means to float low in the molten metal surface, thereby causing a relatively high molten metal level within the mold; and d. thereafter decreasing the downward urging of the said float-distributor means to cause a reduced height of molten metal within the mold, said decreasing of the downward urging of said float-distributor means causes a reduction in the rate of molten metal introduction into the mold to establish an instability condition with respect to molten metal feed and ingot withdrawal rate after which said float-distributor means settles downwardly as a result of decreasing molten metal level in said mold during said instability condition, stability between molten metal feed and ingot withdrawal rates being re-established at said reduced molten metal height, and continuing the casting operation while substantially maintaining said reduced height of molten metal in said mold.

3. The method of continuously casting a light metal ingot within an open-ended mold comprising the steps of:

a. initially closing the exit of said mold by a temporary closure;

b. commencing the casting operation by withdrawing the temporary closure and the solidified ingot attached thereto at a first ingot withdrawal rate; while c. introducing molten metal through a substantially vertical nozzle and spreading it laterally by the action of a distributor-valve constructed as to float within the molten metal and to cooperate with said nozzle to regulate the flow of molten metal passing through said nozzle at a rate substantially commensurate with that of ingot withdrawal;

d. providing said floating distributor with weights to decrease its buoyancy and establish a first molten metal level in said mold;

e. extracting heat from said ingot by a direct chill application;

f. removing said weights from said floating distributor thereby increasing its buoyancy and causing said floating distributor-valve means to rise and decrease the flow of molten metal from the nozzle thereby establishing a condition of instability with respect to molten metal feed and ingot withdrawal rate;

g. increasing the ingot withdrawal rate to a second rate, greater than said first rate;

h. said distributor-valve float means settling downwardly as a result of decreasing molten metal level within the mold during said condition of instability, said molten metal level being re-established under conditions of stability with respect to said molten metal supply rate and said second ingot withdrawal rate but at a second molten metal level lower than said first molten metal level; and i. limiting oxidation and reducing turbulence of the molten metal by the action of a movable floatable plate floating on the molten metal in said floating distributor.

4. The method according to claim 3 wherein the difference between the first and second molten metal levels in the mold is 1 inch or more.

5. The method according to claim 3 wherein the second ingot withdawal rate is at least 25% greater than the first withdrawal rate.

6. In a method of continuously casting ingot wherein molten metal is continuously supplied to the entrance of an open-ended substantially vertical mold and an ingot is withdrawn from the mold exit, and wherein heat is extracted from said ingot by direct chill application, and wherein the supply of molten metal to the mold is controlled at a rate substantially commensurate with that of ingot withdrawal by cooperation between a molten metal supply nozzle and a float-distributor means responsive to molten metal level within the mold, the improvement comprising the steps of:

a. downwardly urging said float-distributor means by placement of one or more weights which bear downwardly upon said float-distributor means to cause said float-distributor means to float lower in the molten metal, thereby causing a relatively high molten metal level within the mold; and b. thereafer decreasing the downward urging of the said float-distributor means by removal of one or more of said weights to cause said float-distributor means to float higher in the molten metal thereby to cause a reduced height of molten metal within the mold and continuing the casting operation while substantially maintaining said reduced height of molten metal in said mold.

7. The method according to claim 1 wherein said removal of said weights is effected by a retraction arrangement situated above said float-distributor means which retracts said weights from said floating-distributor means.

8. The method according to claim 1 wherein a plurality of casting molds are supplied from a common molten metal source and the ingots are concurrently withdrawn therefrom and wherein placement and retraction of said weights is concurrently effected by means common to a plurality of said molds.

9. The method according to claim 1 wherein the rate of ingot withdrawal is increased when casting at the reduced molten metal height in said mold.

10. The method according to claim 1 wherein turbulence of molten metal in said float-distributor means and oxidation of molten metal therein are restricted by the action of a movable floatable plate floating substantially on the molten metal within the destributor means.

11. The method according to claim 1 wherein the molten metal is a non ferrous metal.

12. The method according to claim 1 wherein the molten metal is a light metal selected from aluminum or magnesium or their alloys.

* * * * *

UNITED STATES PATENT AND TRADEMARK OFFICE

CERTIFICATE OF CORRECTION

PATENT NO. : 4,016,924

DATED : 1977 April 12

INVENTOR(S) : Ralph D. Maier

It is certified that error appears in the above-identified patent and that said Letters Patent are hereby corrected as shown below:

| | |
|---|---|
| Col. 1, line 7 | Change "seim" to --semi-- |
| Col. 2, line 7 | Place quotation marks around the word --freeze-- |
| Col. 2, line 14 | Change "ater" to --after-- |
| Col. 2, line 41 | Change "distrubtor" to --distributor-- |
| Col. 3, line 2 | Change "opening" to --openings-- |
| Col. 3, line 21 | Change "porivdes" to --provides-- |
| Col. 4, line 16 | After "molten" insert --metal-- |
| Col. 4, line 39 | Change "portions" to --portion-- |
| Col. 5, line 8 | Change "te" to --the-- |
| Col. 5, line 22 | Place quotation marks around the word --freezing-- |
| Col. 5, line 41 | Place quotation marks around the word --freezing-- |
| Col. 6, line 3 | After "dropped" change "a" to --an-- |
| Col. 6, line 45 | After "conditions" change "of" to --for-- |
| Col. 7, line 5 | Change "one four" to --one fourth-- |

UNITED STATES PATENT AND TRADEMARK OFFICE

CERTIFICATE OF CORRECTION

PATENT NO. : 4,016,924

DATED : 1977 April 12

INVENTOR(S) : Ralph D. Maier

It is certified that error appears in the above-identified patent and that said Letters Patent are hereby corrected as shown below:

| | |
|---|---|
| Claim 1, Col. 8, line 1 | After "establish" change "a" to --an-- |
| Claim 6, Col. 10, line 9 | Change "thereafer" to --thereafter-- |
| Claim 10, Col. 10, line 35 | Change "destributor" to --distributor-- |
| Claims 7 to 12, line 1 - Col. 10 | "claim 1" each occurrence should read --claim 6-- |

Signed and Sealed this

Fourteenth Day of June 1977

[SEAL]

*Attest:*

RUTH C. MASON
*Attesting Officer*

C. MARSHALL DANN
*Commissioner of Patents and Trademarks*